US008016456B2

(12) United States Patent
Paravantsos et al.

(10) Patent No.: US 8,016,456 B2
(45) Date of Patent: Sep. 13, 2011

(54) ROTATABLE REFLECTOR SUPPORT SYSTEM

(75) Inventors: Antonis Paravantsos, Thessaloniki (GR); Stavros Piperidis, Thessaloniki (GR)

(73) Assignee: Pilux & Danpex, S.A., Thessaloniki (GR)

( * ) Notice: Subject to any disclaimer, the term of this patent is extended or adjusted under 35 U.S.C. 154(b) by 92 days.

(21) Appl. No.: 12/371,118

(22) Filed: Feb. 13, 2009

(65) Prior Publication Data

US 2010/0208455 A1 Aug. 19, 2010

(51) Int. Cl.
*F21V 17/02* (2006.01)

(52) U.S. Cl. ..... 362/282; 362/217.05; 362/322

(58) Field of Classification Search ..... 362/217.04, 362/217.05, 217.06, 217.07, 217.08, 277, 362/282, 284, 319, 322, 323, 324, 269, 279
See application file for complete search history.

(56) References Cited

U.S. PATENT DOCUMENTS

| | | | | |
|---|---|---|---|---|
| 2,200,067 | A | 5/1940 | Lehman | |
| 2,308,986 | A | 1/1943 | Livers | |
| 2,314,103 | A | 3/1943 | Raizner | |
| 3,099,403 | A | 7/1963 | Strawick | |
| 4,074,124 | A | 2/1978 | Maute et al. | |
| 4,499,529 | A * | 2/1985 | Figueroa | 362/217.05 |
| 4,669,033 | A | 5/1987 | Lee | |
| 4,739,454 | A | 4/1988 | Federgreen | |
| 4,991,070 | A | 2/1991 | Stob | |
| 5,510,965 | A | 4/1996 | Teakell | |
| 5,655,833 | A | 8/1997 | Raczynski | |
| 6,053,624 | A | 4/2000 | Cronk | |
| 6,244,729 | B1 | 6/2001 | Waldmann | |
| 6,382,817 | B1 | 5/2002 | Chelf | |
| 6,561,678 | B2 | 5/2003 | Loughrey | |
| 6,926,419 | B2 | 8/2005 | An | |
| 7,344,278 | B2 * | 3/2008 | Paravantsos | 362/322 |
| 7,600,907 | B2 * | 10/2009 | Liu et al. | 362/269 |

* cited by examiner

*Primary Examiner* — Y My Quach Lee
(74) *Attorney, Agent, or Firm* — Bruzga & Associates; Charles E. Bruzga; Jay S. Pattumudi

(57) ABSTRACT

Disclosed is a system for the support and rotation of a reflector onto a body of a fluorescent luminary. The luminary body has first and second longitudinal ends along an axis. The rotatable reflector support system comprises an elongated reflector having first and second longitudinal ends. The reflector has first and second arch-shaped fittings proximate to the first and second reflector ends, respectively. First and second bases are mounted on the luminary body and are proximate to the first and second ends of the body, respectively. The side of each base faces the lamp, when the lamp is mounted in the luminary, and is shaped to engage a plurality of serial portions of an associated arch-shaped fitting in a manner allowing serial portions of the fitting, when manipulated, to slide along an arch-shaped path transverse to said axis and to hold the fitting in place when the fitting is not manipulated.

8 Claims, 6 Drawing Sheets

ROTATABLE REFLECTOR SUPPORT SYSTEM

FIELD OF THE INVENTION

This invention is related to a reflector fixation or support system on bodies of fluorescent luminaries even when such luminaries are already installed. More specifically, such a system of reflector fixation provides the ability of reflector's rotation as well as the securing of the reflector in various positions of rotation.

BACKGROUND OF THE INVENTION

The reflectors of the prior art, which are mounted onto the fluorescent luminaries and have the ability, to rotate along the longitudinal axis of a fluorescent lamp, have, as means of support either the lamp itself or some other part, such as the side-walls of the luminary which are properly shaped.

The reflector's fixation on the fluorescent lamp requires the existence of transverse louvers on the reflector's body by which the reflector is fixed on the lamp.

In certain previous patents, the support of reflectors on the fluorescent lamp results in the inability to remove the lamp from its lamp-holders, without also removing the reflector at the same time. Or in certain other patents in order to remove the lamp, the louvers of the reflector would have to, be disconnected from the lamp or from the reflector's body.

Furthermore, there are laboratories of compliance control with International and National Standards such as UL of USA that do not accept the reflector kit to be supported or fixed onto a fluorescent lamp.

Supporting the reflector on side end walls are only feasible on originally manufactured luminaries that bear a proper formation on their side end walls. This is because the addition of side accessories for a reflector support, on already installed luminaries, obstructs the insertion and removal of at lamp from its lampholders or forces the lamp to be removed from the luminary along with the reflector.

It would be desirable to provide a reflector that can be placed on the body of any fluorescent luminary without obstructing the replacement of the fluorescent lamp. It is also desirable that the reflector can be rotated in various serial positions about the longitudinal axis of the fluorescent lamp and can be secured in various positions of its rotation.

SUMMARY OF THE INVENTION

Based on an invention version, a system is provided for the support and rotation of a reflector onto a body of a fluorescent luminary. The luminary includes an elongated luminary body for concealing electrical supply wires. The luminary body has first and second longitudinal ends along an axis. The rotatable reflector support system comprises an elongated reflector having first and second longitudinal ends. The reflector has first and second arch-shaped fittings proximate to the first and second reflector ends, respectively. First and second bases are mounted on the luminary body and are proximate to the first and second ends of the body, respectively. The side of each base faces the lamp, when the lamp is mounted in the luminary, and is shaped to engage a plurality of serial portions of an associated arch-shaped fitting in a manner allowing serial portions of the fitting, when manipulated, to slide along an arch-shaped path transverse to said axis and to hold the fitting in place when the fitting is not manipulated.

Thus, the arch-shaped fittings located on the reflector's ends in the foregoing invention version are rotated inside the arch-shaped guide of the base, therefore, also rotating the reflector, and the engagement of the rib with a recess of the arch-shaped fitting, secures the reflector at a designated position of rotation.

The reflector is fixed onto a base on the fluorescent luminary body, and rotates independently from the fluorescent lamp. For lamp replacement the actual reflector does not need to be removed together with the lamp.

DETAILED DESCRIPTION OF THE INVENTION

Figure 1:
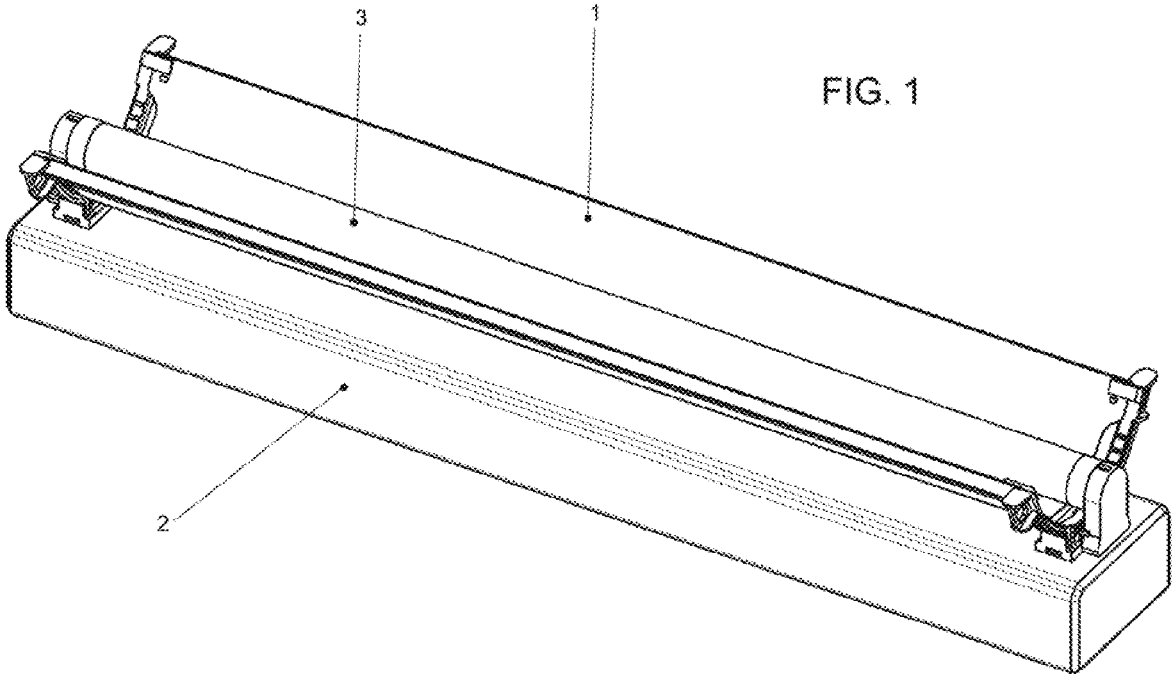
FIG. 1 is a perspective view of a reflector fitted onto the body of a luminary with a fluorescent lamp in accordance with one version of the invention.

FIG. 1 shows the reflector 1 fitted onto the luminary 2 body behind the fluorescent lamp 3, with the aid of its support and rotation system. Reflector 1 is preferably of integrated parabolic shape.

Figure 2:
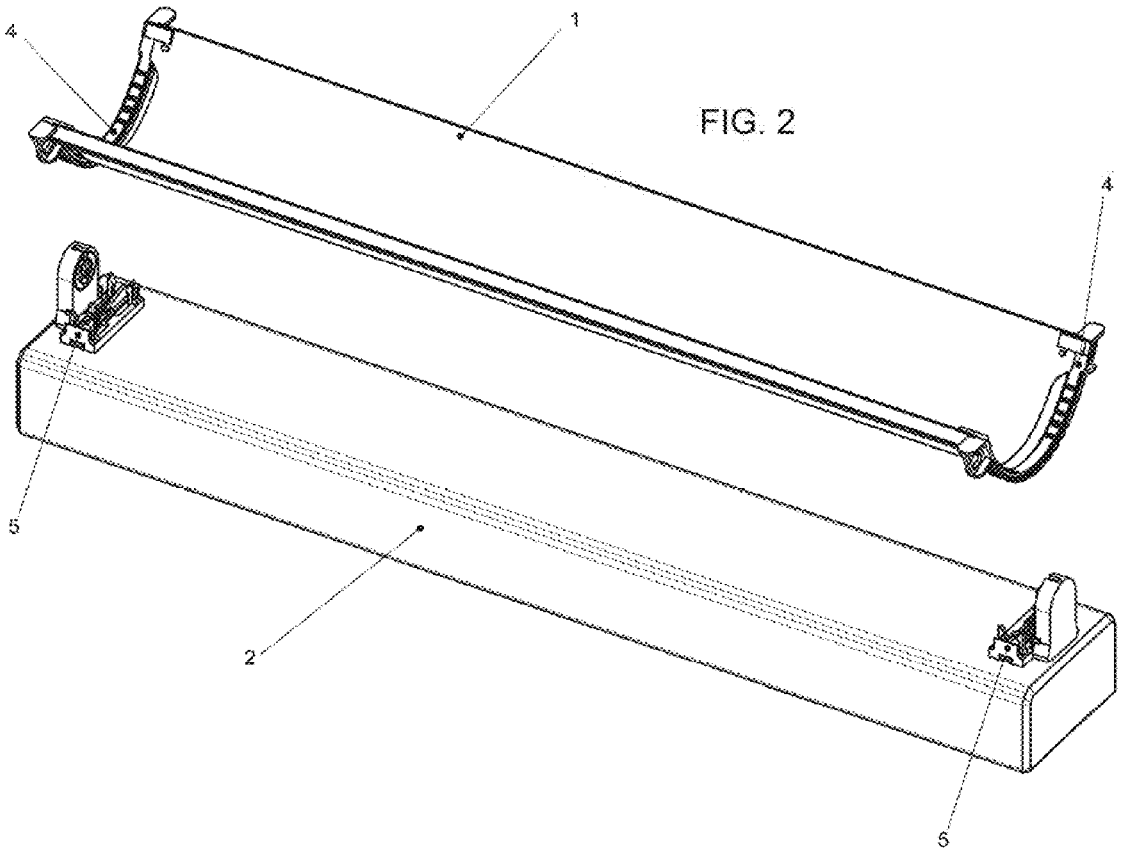
FIG. 2 is a perspective view of some of the parts shown in FIG. 1, including an arch-shaped fitting separated from the luminary body with the reflector support base, before installation.

As it appears in FIG. 2, the reflector 1 is designed to be mounted onto the luminary 2 body through arch-shaped fittings 4 at each end of the reflector and associated reflector bases 5 that are respectively fixed onto each end of the luminary body.

Figure 3:
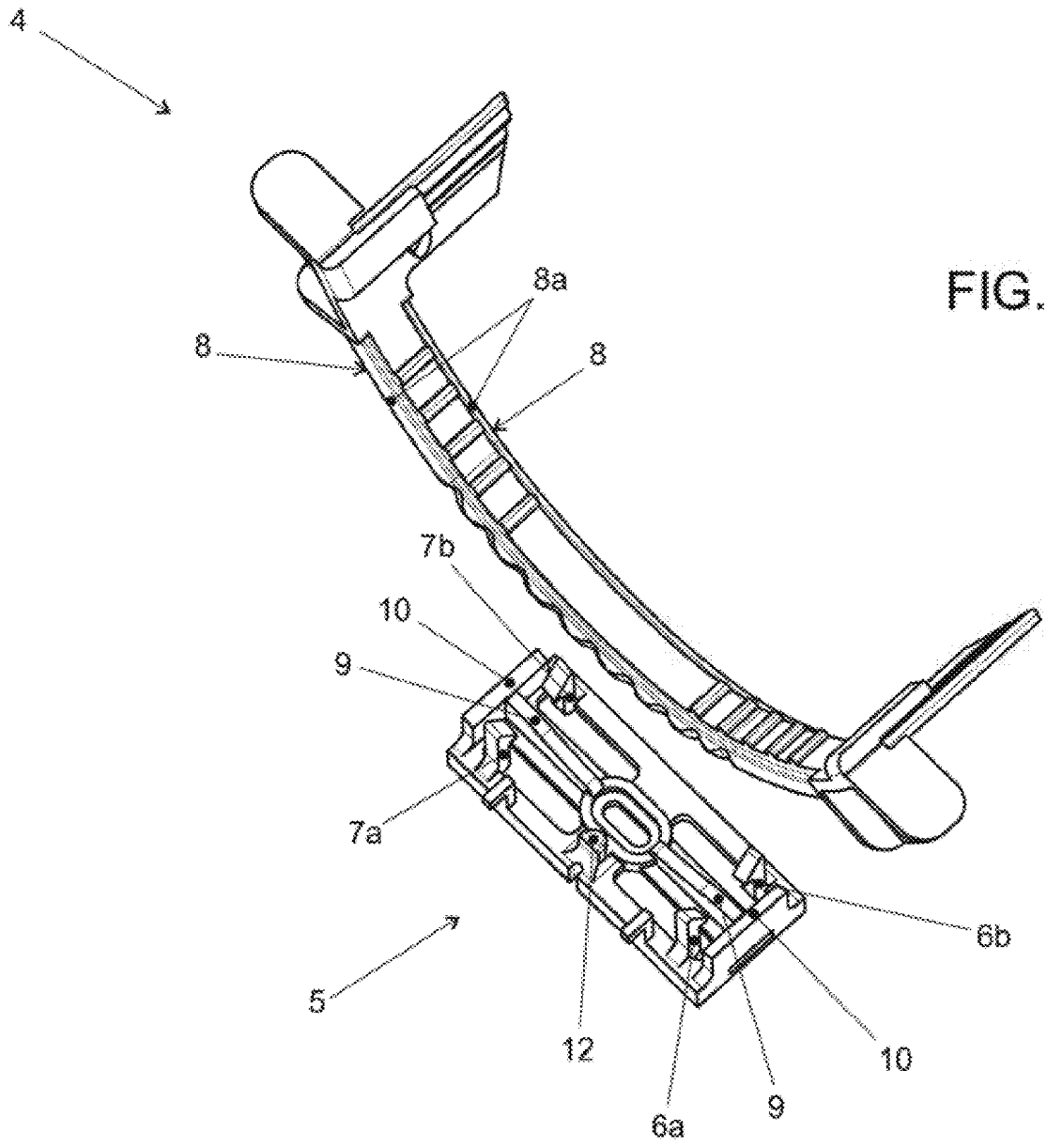
FIG. 3 is a detail view in perspective of one, of the bases and associated arch-shaped fitting from FIG. 1, one separate from the other.
Figure 4:
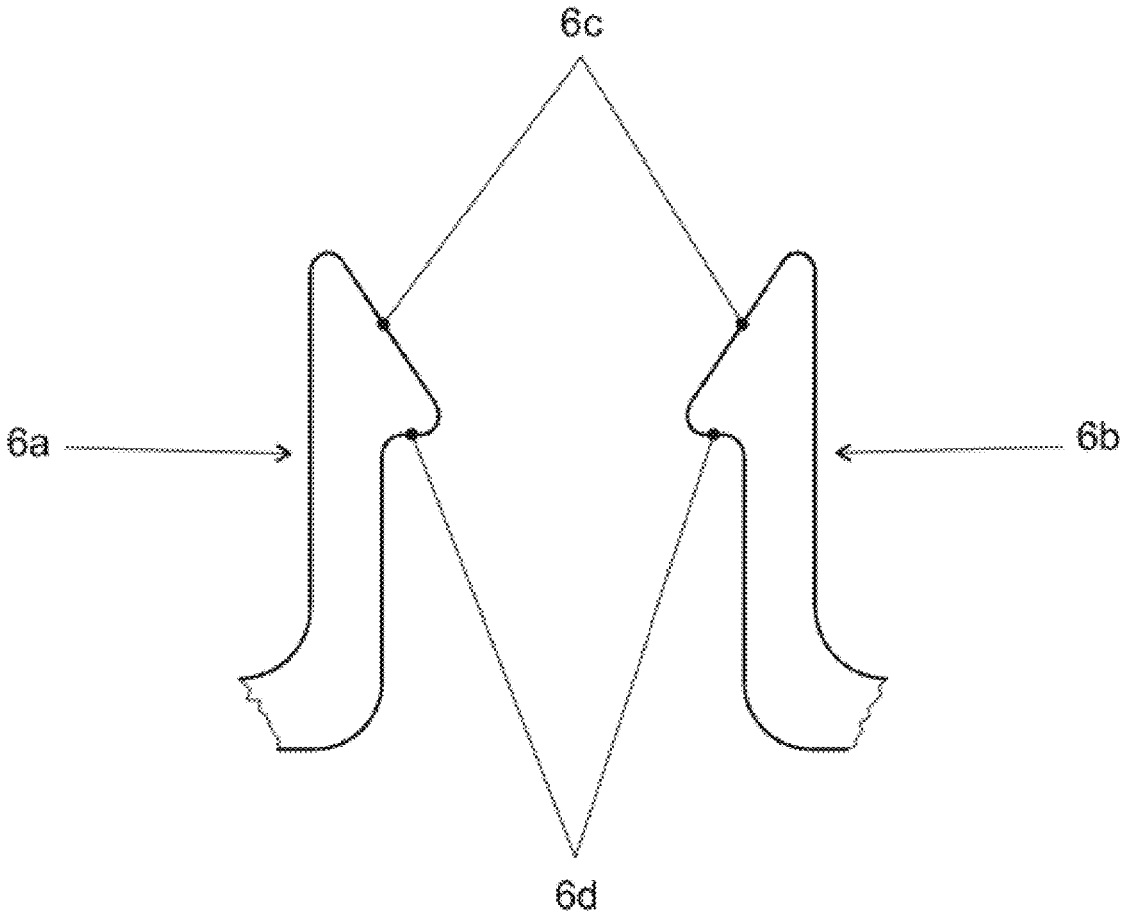
FIG. 4 is a side detail view of flexible shanks of a base from FIG. 1.

FIG. 3 shows first and second flexible shanks 6*a* and 6*b*, as well as third and fourth flexible shanks 7*a* and 7*b* of each base. FIG. 4 shows a detail of first and second shanks 6*a*, 6*b*. The third and fourth flexible shanks 7*a*, 7*b* preferably have the same construction of shanks 6*a*, 6*b*, so that a separate description of shanks 7*a*, 7*b* is unnecessary.

Referring to FIG. 4, the first and second flexible shanks 6*a*, 6*b* have respective inclined surfaces 6*c* facing each other along the longitudinal axis of the luminary body, so as to guide insertion of a respective arch-shaped fitting 4 of the reflector (e.g., FIG. 3) between the flexible shanks 6*a*, 6*b* and 7*a*, 7*b*.

As shown in FIG. 4, each of the flexible shanks 6*a* and 6*b* has a respective lock flange 6*d* for engaging the respective lock surface 8*a* of a lock flange 8 of an associated arch-shaped fitting 4 (e.g., FIGS. 3, 5 and 6), to prevent the fitting from separating from the base.

Figure 6:
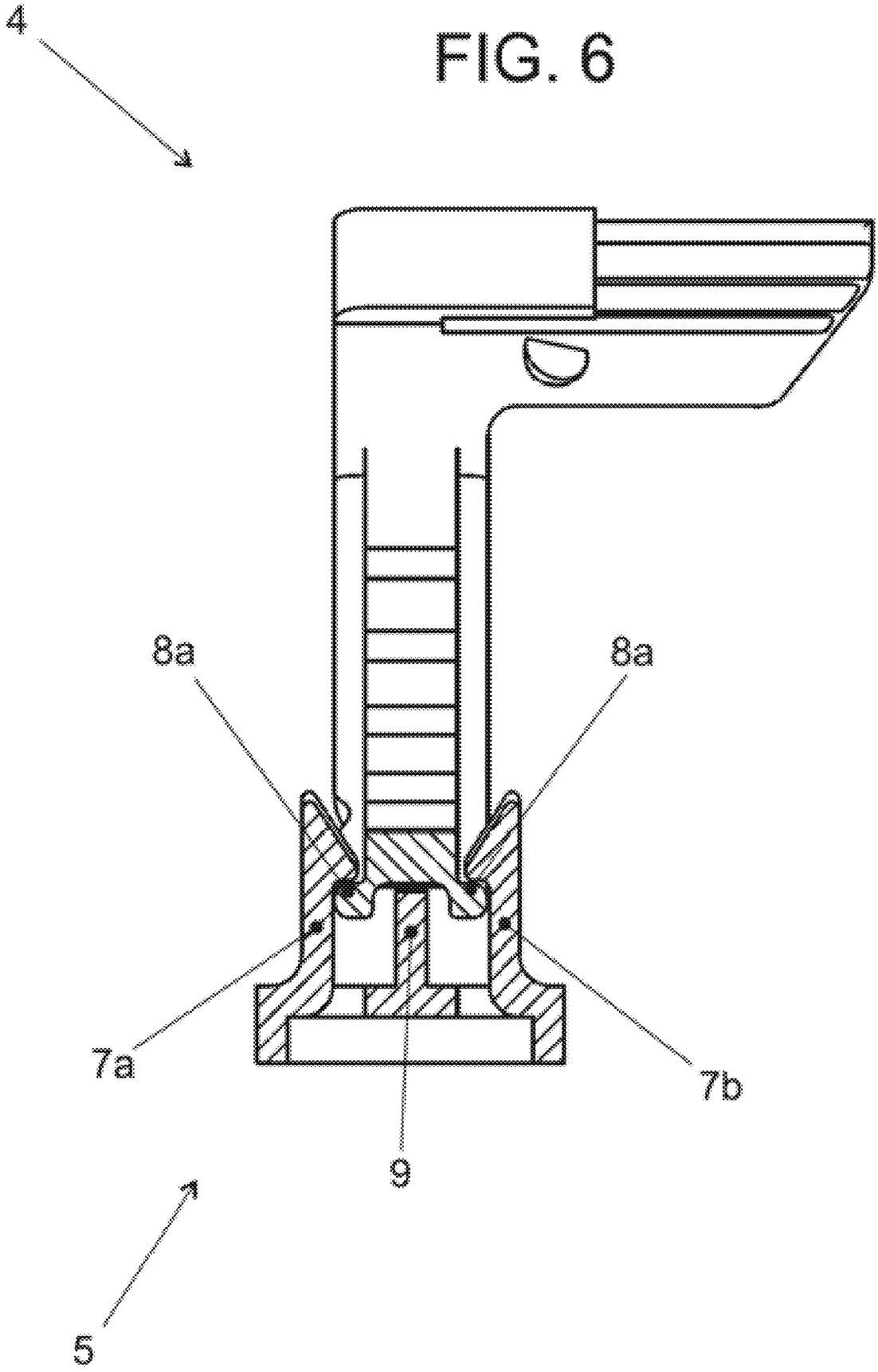
FIG. 6 is a cross-sectional view of the base and the arch-shaped fitting of FIG. 5 taken at arrows 6-6 in FIG. 5, in which the base and fitting are joined together as they are when the reflector is fitted onto the luminary body.

With reference to FIGS. 3 and 6 concerning the base 5 the positions of the flexible shanks 6*a*, 6*b*, and 7*a*, 7*b* and their lock flanges, as well as a surface 9 of the base 5 onto which the associated arch-shaped fitting 4 is mounted, form an arch-shaped guide into which the associated fitting 4 slides. However, it would be adequate for the lock flanges 8 of the arch-shaped fitting to be held along a radial direction from the longitudinal axis of the fluorescent lamp (e.g., 3, FIG. 1), from a radially inner position by a pair of lock flanges (e.g., 6*a*, 6*b*) of a pair of flexible shanks of a base, and from a radially outer position by a small portion of surface 9 or of surface 10, by way of example.

Figure 5:
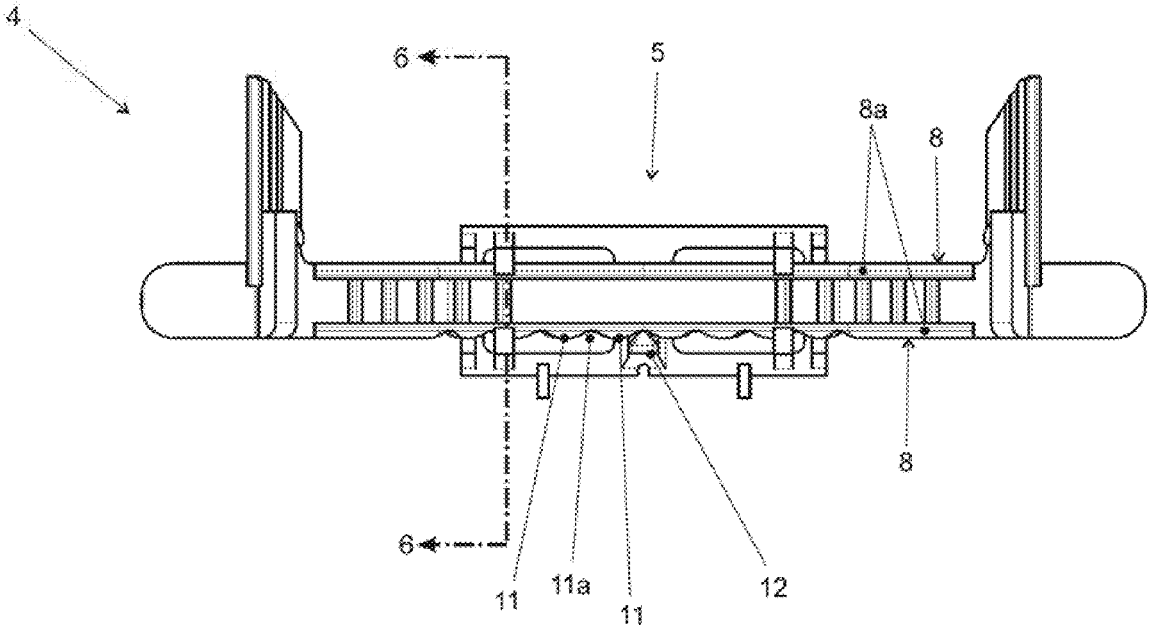
FIG. 5 is a top view of the base and the arch-shaped fitting of FIG. 3, joined together, as they are when the reflector is placed onto the luminary body.

FIG. 5 shows the arch-shaped fitting 4 as having a series of spaced wall portions 11 forming recesses 11*a* oriented along the longitudinal axis of the luminary body, while the base has a cooperative rib 12 along the same axis for being received within one of said recesses 11*a* for holding the arch-shaped fitting 4 in place, when it is not manipulated.

In the operation of the invention, by sliding the two arch-shaped fittings 4 into the guides of the two bases 5, the reflector 1 rotates around the fluorescent lamp 3 in various serial positions, thus changing the direction of the luminary's light beam.

By engaging a recess 11*a* of the arch-shaped fitting 4 and the cooperating rib 12 of a base 5, the reflector 1 remains stable at one position when it is not being manually rotated around the fluorescent lamp 3.

When the fluorescent lamp 3 needs to be taken out from the luminary, the reflector 1 remains in place, without hindering the removal of the lamp.

While the invention has been described with respect to specific embodiments by way of illustration, many modifications and changes will occur to those skilled in the art. For instance, rather than using two pairs of flexible shanks 6*a*, 6*b*, 7*a*, 7*b* for each base 5, it is possible to use only a single pair of flexible shanks for a base. It is, therefore, to be understood that the appended claims are intended to cover all such modifications and changes as fall within the true scope and spirit of the invention.

What is claimed is:

1. A rotatable reflector support system for a fluorescent lamp luminary, wherein the luminary includes an elongated luminary body for concealing electrical supply wires; the luminary body having first and second longitudinal ends along an axis; the rotatable reflector support system comprising:

a) an elongated reflector having first and second longitudinal ends; the reflector having first and second arch-shaped fittings proximate to the first and second reflector longitudinal ends, respectively; and b) first and second bases mounted on respective surfaces of the luminaire body, wherein said respective surfaces are substantially aligned with said axis and are proximate to the first and second ends of the body, respectively; wherein a side of each base faces the lamp, when the lamp is mounted on the luminary, and is shaped to engage a plurality of serial portions of an associated arch-shaped fitting of the reflector in a manner allowing serial portions of the fitting, when manipulated, to slide along an arch-shaped path transverse to said axis and to hold the fitting in place when the fitting is not manipulated; and c) each base and associated arch-shaped fitting being shaped and oriented such that the foregoing arch-shaped fitting is initially spaced apart from the foregoing base, and then is overlaid onto the foregoing base, and engaged with the forgoing base, in a direction transverse to said axis.

2. The system of claim 1, wherein each base has an arch-shaped surface that engages with an arch-shaped surface of an associated arch-shaped fitting.

3. The system of claim 1, wherein:

a) each base has first and second flexible shanks aligned along said axis;

b) each fitting has a pair of arch-shaped locking surfaces respectively extending away from each other in a direction parallel to said axis; and c) the first and second shanks each have a respective lock flange for engaging the respective lock surface of an associated fitting, to prevent the fitting from separating from an associated base.

4. The system of claim 3, wherein:

a) each base has third and fourth flexible shanks aligned along said axis; and b) the third and fourth shanks each have a respective lock flange for engaging the respective lock surface of an associated fitting, to prevent the fitting from separating from an associated base.

5. The system of claim 4, wherein the first and second flexible shanks have respective inclined surfaces facing each other along said axis and the third and fourth flexible shanks have respective inclined surfaces facing each other along said axis; said surfaces being for guiding insertion of a respective fitting of the elongated reflector between the shanks.

6. The system of claim 3, wherein:

a) each fitting has a series of spaced wall portions forming recesses oriented along said axis; and b) each base has a cooperating rib projecting along said axis for being received within one of said recesses for holding the associated fitting in place, when the fitting is not manipulated.

7. The system of claim 6, wherein:

a) each base has third and fourth flexible shanks aligned along said axis;

b) the third and fourth shanks each having a respective lock flange for engaging the respective lock surface of an associated fitting, to prevent the fitting from separating from an associated base; and c) each rib is positioned between an associated pair of first and second shanks and an associated pair of third and fourth shanks.

8. The system of claim 7, wherein the first and second flexible shanks have respective inclined surfaces facing each other along said axis and the third and fourth flexible shanks have respective inclined surfaces facing each other along said axis; said surfaces being for guiding insertion of a respective fitting of the elongated reflector between the shanks.

* * * * *